US006418641B1

(12) United States Patent
Schenkel

(10) Patent No.: US 6,418,641 B1
(45) Date of Patent: Jul. 16, 2002

(54) SPORT SHOE WITH STRUCTURAL FRAME

(76) Inventor: Decio Luiz Schenkel, Rua General Emilio Lucio Esteves, 1353, Taquara-RS (BR)

( * ) Notice: Subject to any disclaimer, the term of this patent is extended or adjusted under 35 U.S.C. 154(b) by 0 days.

(21) Appl. No.: 09/247,050

(22) Filed: Feb. 9, 1999

(30) Foreign Application Priority Data

Nov. 2, 1998 (BR) ..... 9800597

(51) Int. Cl.[7] ..... A43B 13/18
(52) U.S. Cl. ..... 36/28; 36/30 R; 36/102
(58) Field of Search ..... 36/28, 30 R, 29, 36/3 B, 8.1, 31, 102

(56) References Cited

U.S. PATENT DOCUMENTS 2,884,716 A * 5/1959 Shelare et al.
4,290,211 A * 9/1981 Csengeri
4,525,940 A * 7/1985 Mochizuki
4,616,431 A * 10/1986 Dassler
4,676,010 A * 6/1987 Cheskin
4,878,300 A * 11/1989 Bogaty
4,897,936 A * 2/1990 Fuerst
5,280,680 A * 1/1994 Burke et al.
5,325,611 A * 7/1994 Dyer et al.
5,367,791 A * 11/1994 Gross et al.
5,367,792 A * 11/1994 Richard et al.
5,561,920 A * 10/1996 Graham et al.
5,709,954 A * 1/1998 Lyden et al.
5,806,209 A * 9/1998 Crowley et al.
5,852,886 A * 12/1998 Slepian et al.
B15,044,096 A * 12/1998 Polegato

* cited by examiner

*Primary Examiner*—Ted Kavanaugh

(57) ABSTRACT

A sport shoe includes an upper affixed to a structural frame system composed of a shock absorbing insole adhesively attached to the upper, a frame with front and rear cutouts adhesively secured to the insole to provide stability and impulsion to the shoe, and a sole made up of plural separate parts which are adhesively secured to the frame to impart traction and durability to the shoe, with one or more of the sole parts having a cutout which coincides with a cutout in the frame

4 Claims, 7 Drawing Sheets

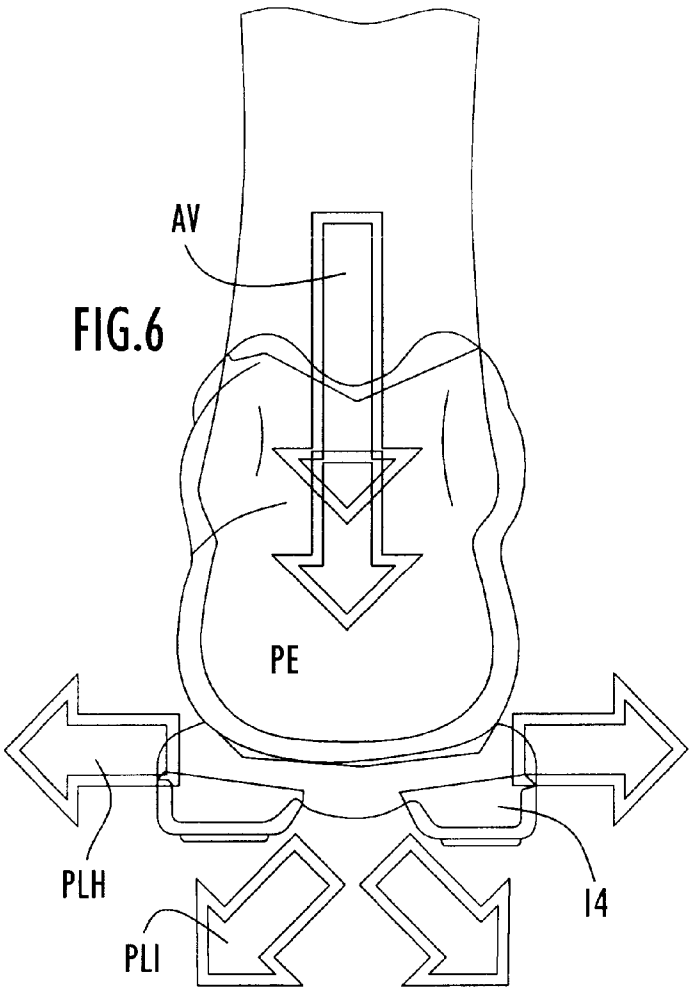
FIG.6
FIG.5
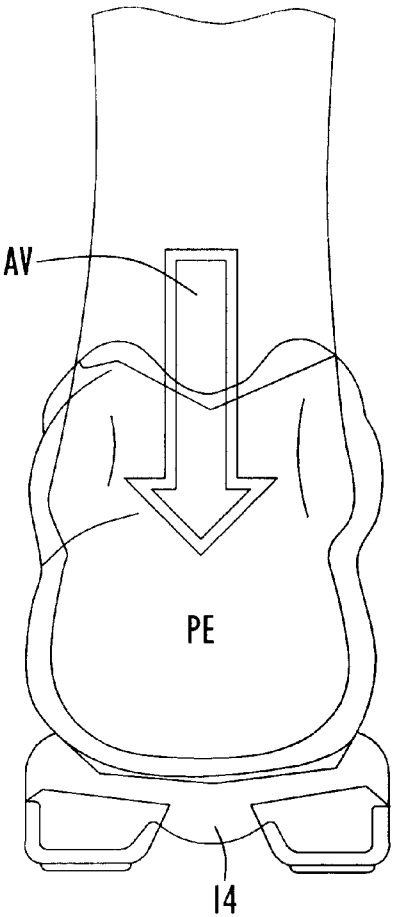

SPORT SHOE WITH STRUCTURAL FRAME

BACKGROUND AND SUMMARY OF THE INVENTION

The present invention relates primarily to a sport shoe for use in any sport activity, although the shoe construction disclosed herein can be employed in any type of shoe. The inventive concept involves use of a frame system, or a structural frame, that protects the users feet, by providing a shock absorbing structure not only to user's body but also, and principally, to the user's feet. Prior art sport shoes have elasticity or flexibility in the shoe sole area, which protects the user's body, but does not protect, in an adequate or thorough way, the user's feet. As a result, the bones of the feet must act as a support and perform an absorbing function. Conversely, and as an improvement when compared to the existing state of the art, the sport shoe of the present invention aims at protecting, in accordance with its inventive concept, not only the user's body but principally the users feet, i.e., bones, muscles, nerves, etc., thereof.

The present invention is generally characterized in a shoe including an upper made up of any suitable material, such as leather, natural or artificial fabric, and a structural frame composed of an Insole affixed to the upper, a frame affixed to the insole and including front and rear cutouts, and a sole made up of three separate parts affixed to the frame, two of the parts having cutouts corresponding respectively to the front and rear cutouts in the frame. The insole is preferably positioned adjacent and just below the upper, being fixed thereto with glue. The insole can be manufactured from any suitable material but is preferably manufactured from materials which, are similar or equivalent to ethyl vinyl acetate or polyurethane in terms of their resiliency and shock absorbing characteristics. The frame is preferably positioned adjacent and just below the insole, being fixed thereto with glue and manufactured from any suitable material with firmness, high flexibility and impulse amplitude and shock absorbability. Preferably, the frame is manufactured from a material similar or equivalent to a compound made up of plastic material including nylon and Pebax (a nylon and polyurethane mixture), or a compound made up of carbon fiber, or Keviar, aiming at firmness, high flexibility and impulse amplitude and shock absorbability. The sole preferably includes separate front, rear and intermediate parts. The intermediate part of the sole is preferably formed with a cutout which coincides with the front cutout of the frame, The rear part of the sole is preferably formed with a cutout which coincides with the rear cutout of the frame. The front part of the sole preferably forms a toe-cap, with the front, rear and intermediate parts of the sole preferably being fixed to the frame with glue and manufactured from similar or equivalent materials to rubber, aiming at adherence, friction, traction and durability.

The invention will be better understood and appraised by way of the enclosed drawings, referred to by figures briefly described as follows, when examined along with the description below.

BRIEF DESCRIPTION OF THE DRAWINGS

FIG. 5 is a schematic rear view of a shoe according to the present invention on a user's foot illustrating the pressure (shown by an arrow) exerted by the foot on the shoe.

FIG. 6 is a schematic rear view of the shoe of FIG. 5 illustrating the resulting reactions (shown by arrows) of the impact exerted by the pressure shown in FIG. 5.

DESCRIPTION OF THE PREFERRED EMBODIMENTS

Figure 1:
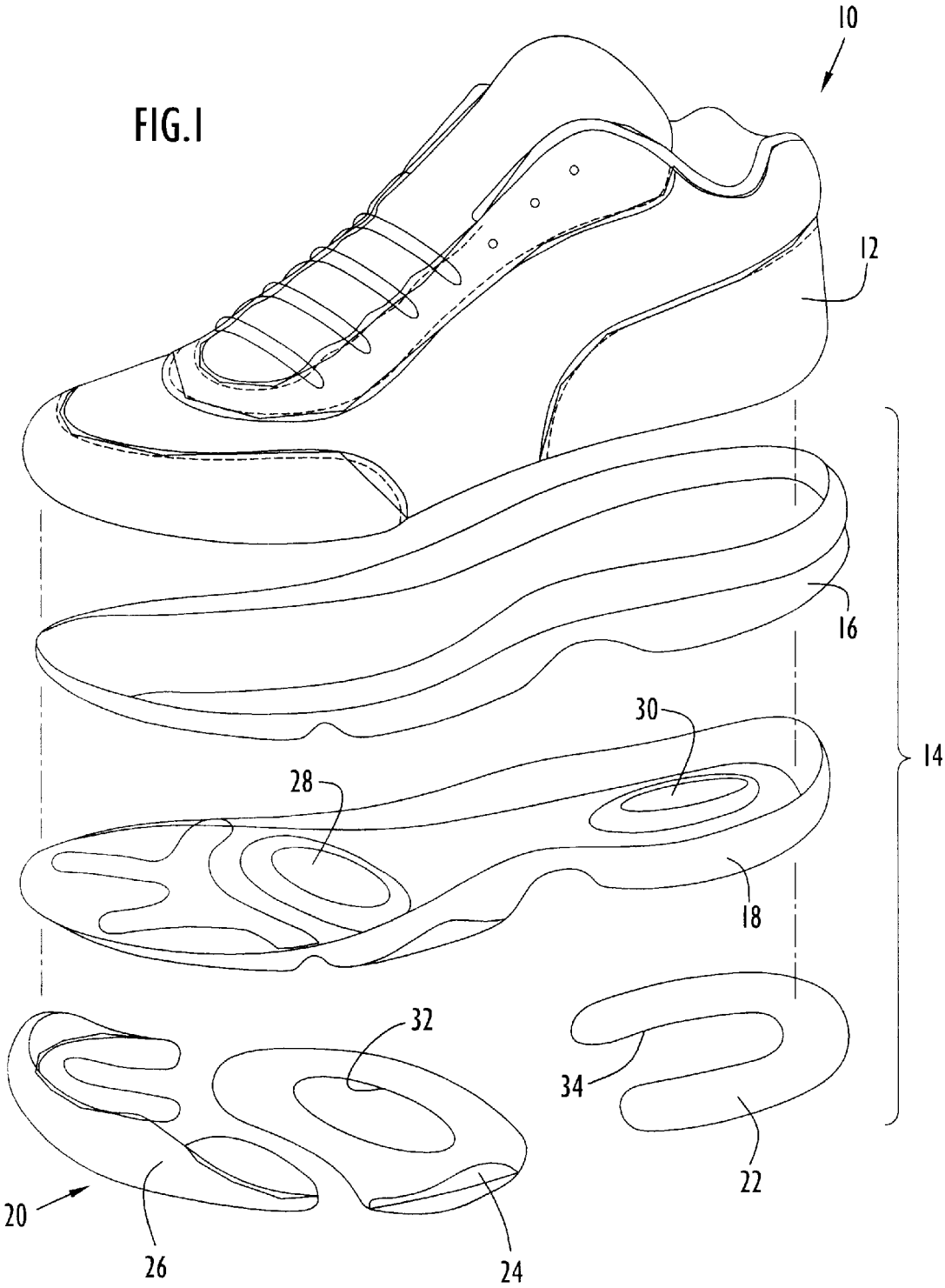
FIG. 1 is an exploded perspective view of a shoe according to the present invention.
Figure 2:
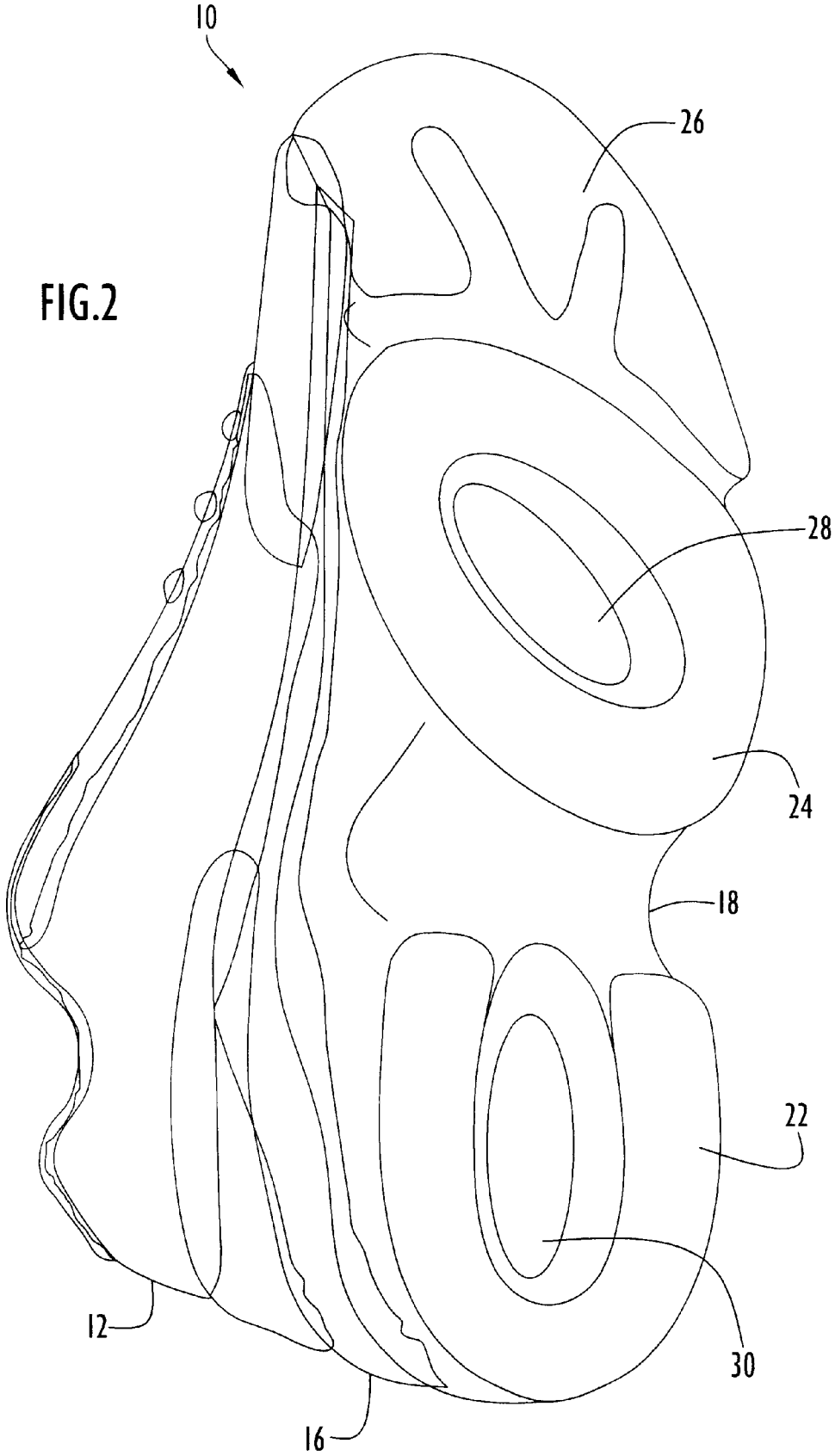
FIG. 2 is a perspective view of the shoe as seen from below.

A shoe 10 according to the present invention, as illustrated in FIGS. 1 and 2, includes an upper 12 and a structural frame system 14 disposed beneath the upper. As best seen in FIG. 1, the three basic parts of structural frame system 14 are an insole 16, a frame 18, and a sole 20 made up of a plurality of separate parts 22, 24 and 26. Components 16, 18 and 20 are united to form structural frame system 14 which is secured to the bottom of upper 12. In a preferred embodiment, the structural frame components are united together using an adhesive or glue, which can also be used to attach the structural frame system to upper 12. Referring still to FIG. 1, it can be seen that frame 18 has first and second cutouts 28 and 30, respectively, in the front and rear areas of the frame. Middle or intermediate part 24 of sole 20 has an annular, ring-like configuration defining a first opening or cutout 32 which corresponds to first cutout 28 of shoe frame 18, and rear part 22 of the sole has a generally U-shaped configuration defining a second open area or cutout 34 corresponding to second cutout 30 at the rear of frame 18. In the assembled condition or state, shown in FIG. 2, structural frame system 14 is attached to upper 12 such that cutout 34 in part 22 of the sole is aligned with cutout 30 in frame 18, and cutout 32 in part 24 of the sole is aligned with cutout 28 in the frame. It can also be seen in FIG. 2 that parts 22 and 24 of the sole are independent of and spaced from front part 25 of the sole to provide better flexibility to the shoe, allowing for a higher impulsion to the user, when participating in a sports activity.

Figure 4:
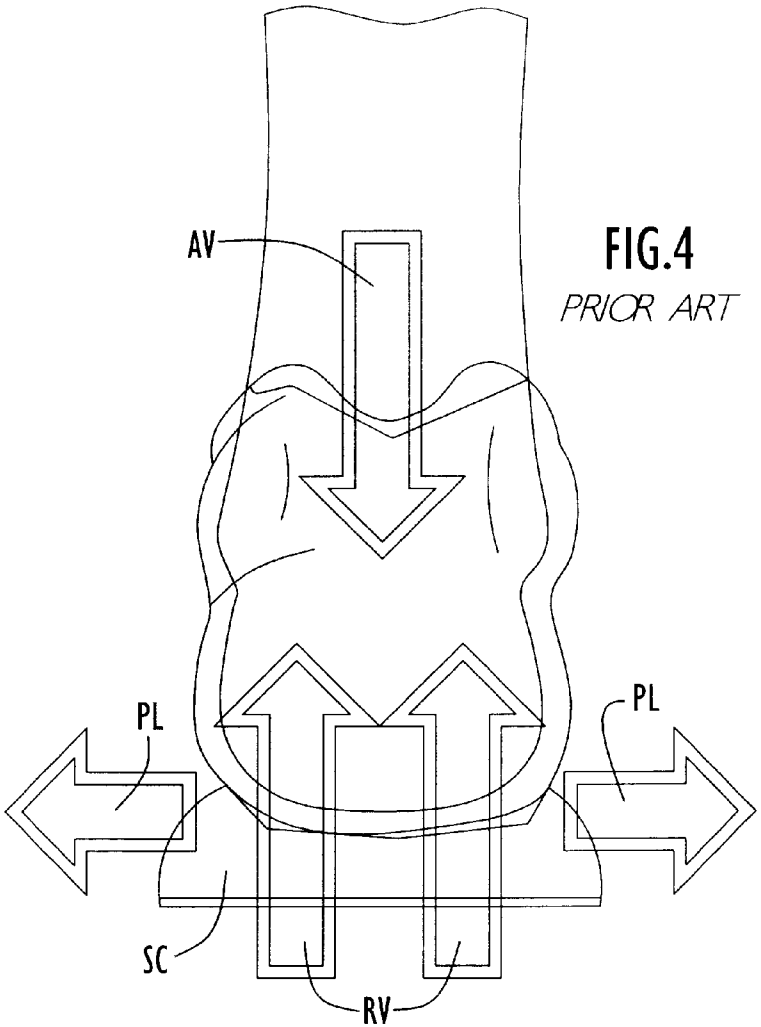
FIG.4 PRIOR ART
FIG. 4 is a schematic rear view of a prior art shoe on a user's foot illustrating the resulting reactions (shown by arrows) of the impact resulting from the pressure shown in FIG. 3.
Figure 3:
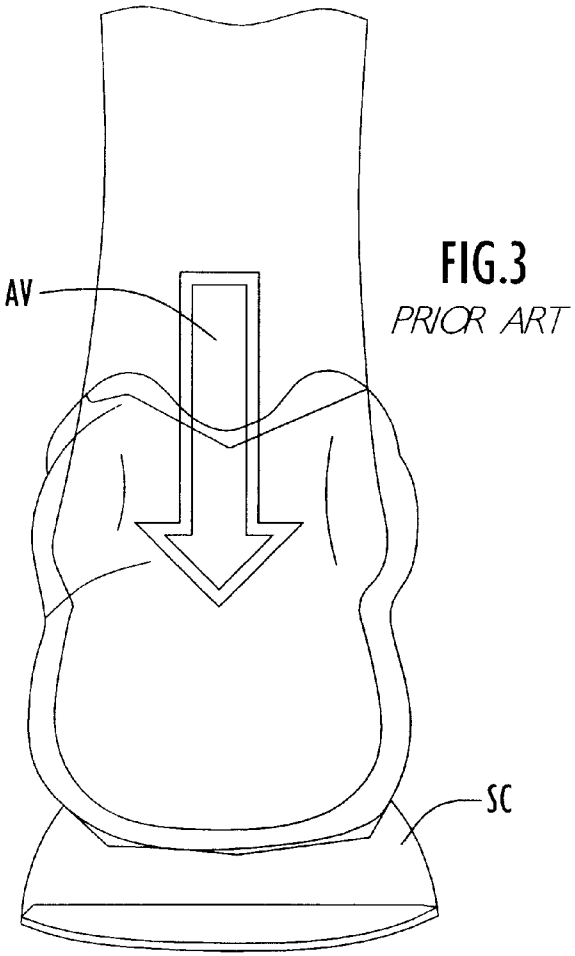
FIG.3 PRIOR ART
FIG. 3 is a schematic rear view of a prior art shoe on a user's foot illustrating the pressure (shown by an arrow) exerted by the foot on the shoe.

In a prior art shoe having an ordinary sole SC, the user's foot exerts a vertical force or action on the sole as shown by arrow AV in FIG. 3. The vertical action AV exerted by the user's foot is applied as a pressure over sole SC which, referring to FIG. 4, returns part of the pressure to the foot as shown by arrows RV (vertical reaction) and frees or redirects part of the pressure laterally as shown by arrows PL (freed pressures). By way of contrast, when using a shoe having a structural frame according to the present invention, little or no reaction Is returned to the user's foot. Referring to FIG. 5, a vertical force or action exerted on structural frame 14 by the user's foot PE is represented by arrow AV. In FIG. 6, it can be seen that the vertical action on foot PE (shown by arrows AV) forces or loads the shoe precisely on its structural frame system 14 and the overall vertical action AV is freed or redirected laterally outward from the shoe by way of the side resultants or horizontal freed pressures shown by arrows PLH and the downwardly inclined freed pressures shown by arrows PLI. In other words, reaction forces on the foot are reduced by allowing insole 16 to protrude or bulge in a generally downward direction through cutouts 28 and 30 In frame 18 while at the same time expanding laterally outward in a horizontal direction in response to the compressive force AV. Thus, the user's feet suffer little or no impact, since all pressure exerted by the feet does not return to the users feet.

Figure 7:
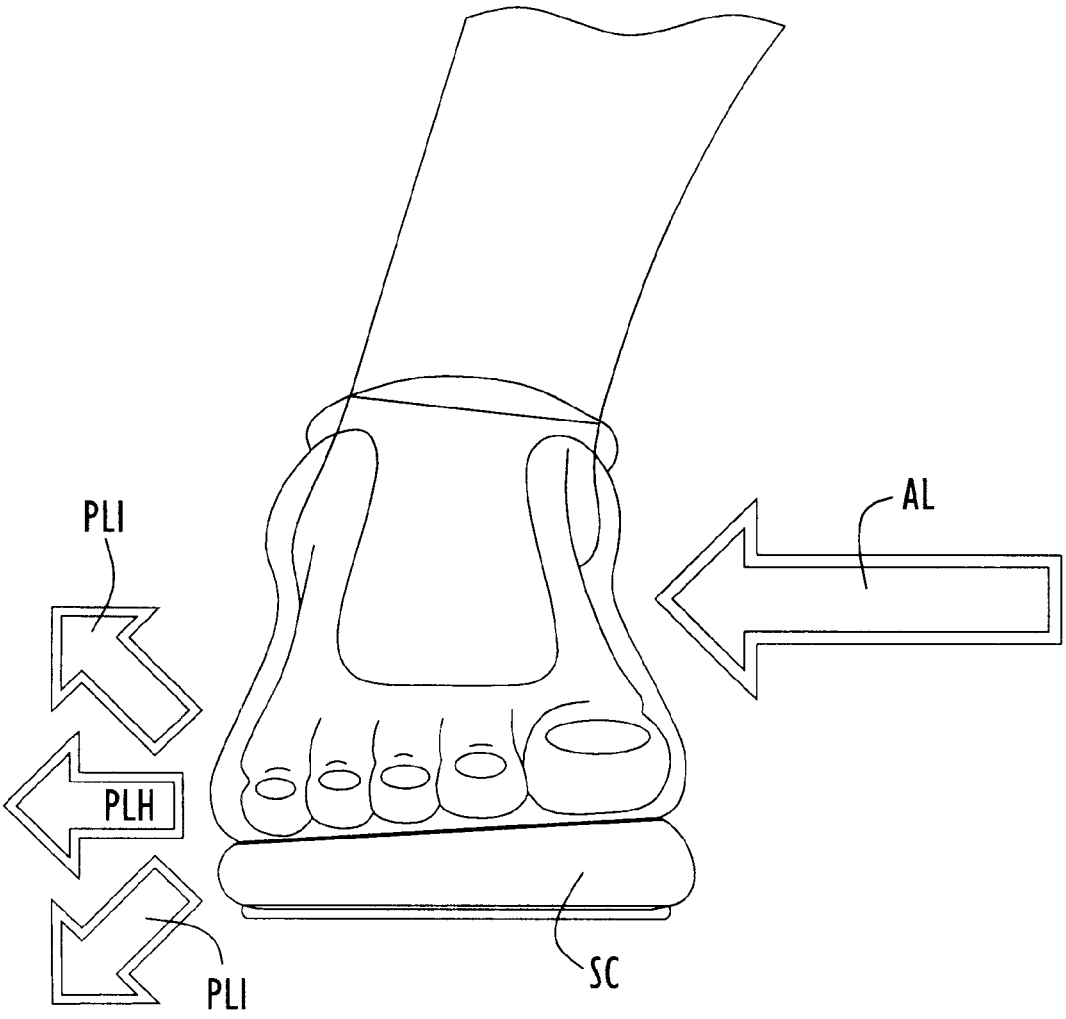
FIG. 7 is a schematic front view of a prior art shoe on a users foot illustrating the pressure made (shown by arrows) by a lateral impact as applied to the shoe and the resulting reactions.

Use of a structural frame according to the present invention also improves lateral stability. In FIG. 7, a prior art shoe is shown subjected to a lateral force, pressure or side action AL originated from or exerted by the user's foot. The lateral pressure exerted on the shoe by the user's foot is converted into inclined pressures (shown by arrows PLI) and horizontal pressures (shown by arrows PLH) which load the sole SC. Due to the excessive lightness of prior art sport shoes, such pressures can cause the soles to compress on one side of the shoe such that the shoes exhibit a lack of stability during the sport activity, which can lead to severe torsions (to the user's feet), as for example excessive pronation and supination.

Figure 8:
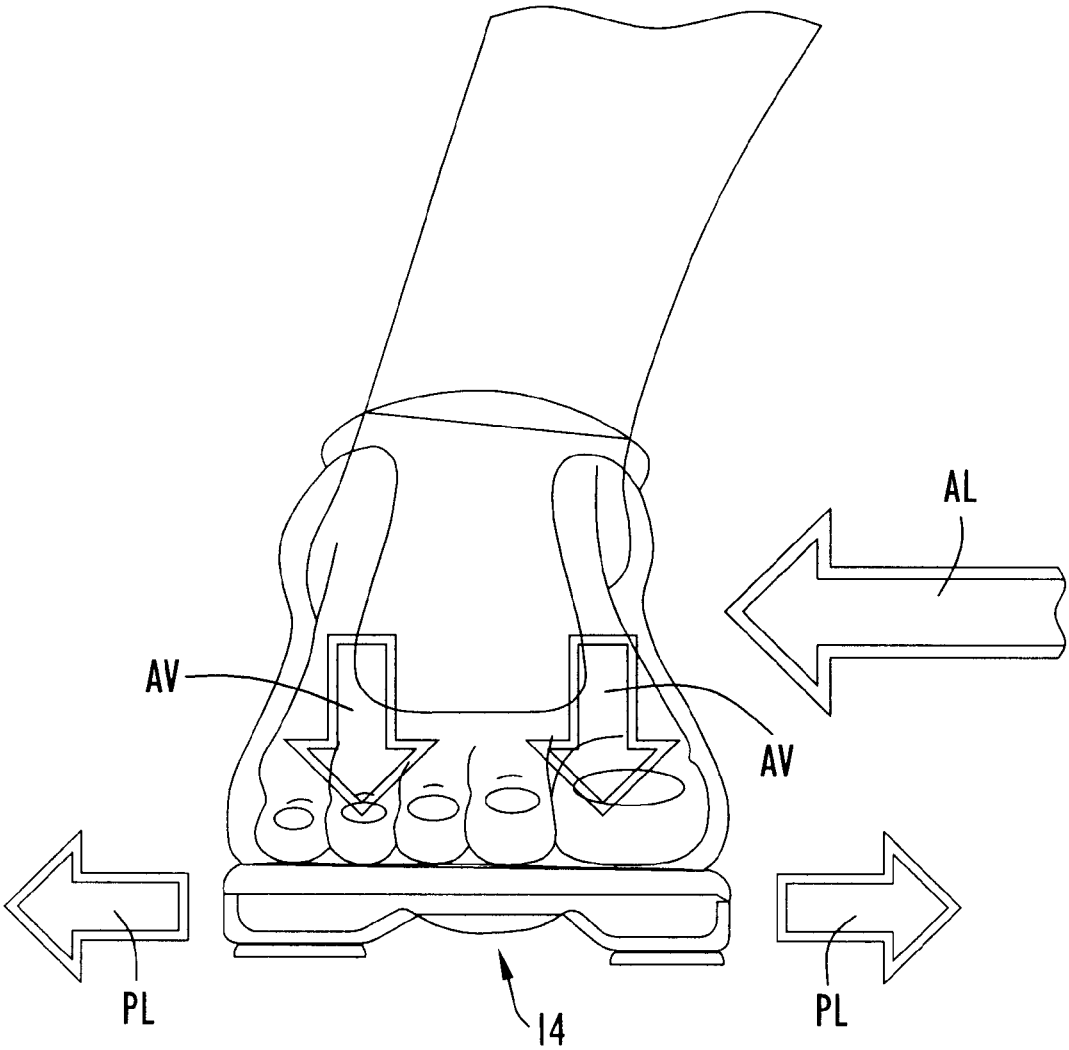
FIG. 8 is a schematic front view of a shoe according to the present invention on a user's foot illustrating the resulting reactions when lateral pressure (shown by arrows) is applied to the shoe.

By way of contrast, when a lateral action or force AL is exerted on a shoe according to the present invention as shown in FIG. 8, structural frame system 14 converts the lateral action into vertical actions or forces (shown by arrows AV) which act on both sides of the shoe. This leads to a more even distribution of the resulting lateral forces PL on opposite sides of the shoe, giving rise to improved firmness for the shoe, as well as exceptional comfort and stability for the user. This fact stems from the comprehensive manner frame 18 occupies the whole area destined to the sole, providing firmness and flexibility and distributing pressure in a proportional way to insole 16.

Figure 9:
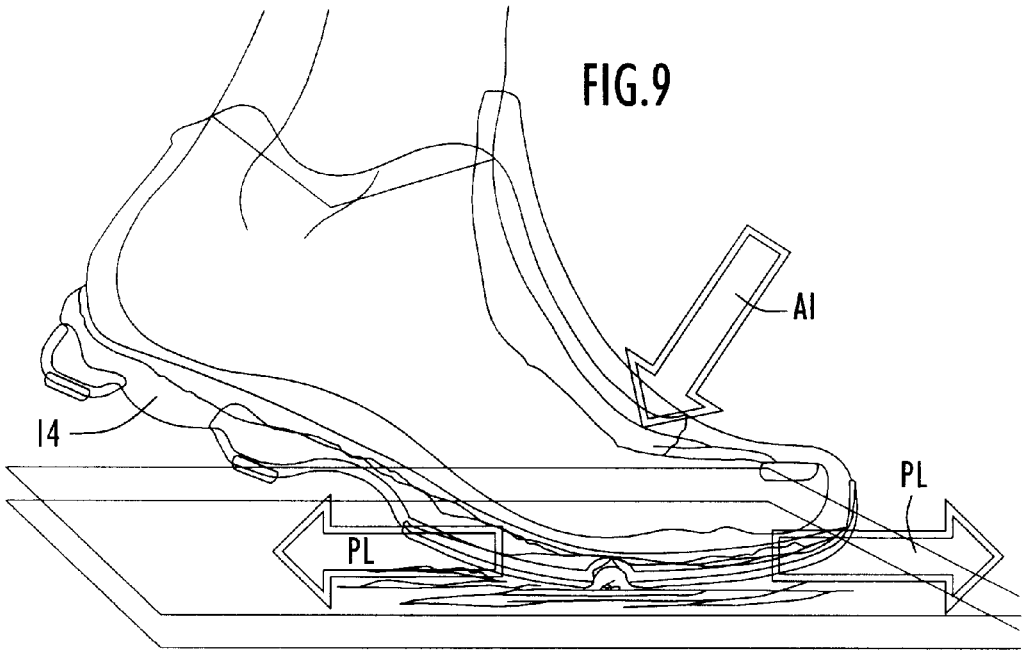
FIG. 9 is a schematic side view of a shoe according to the present invention on a user's foot illustrating flexion (shown by arrows) in the shoe when the user firms the foot for an impulsion, by applying pressure on the ground.
Figure 10:
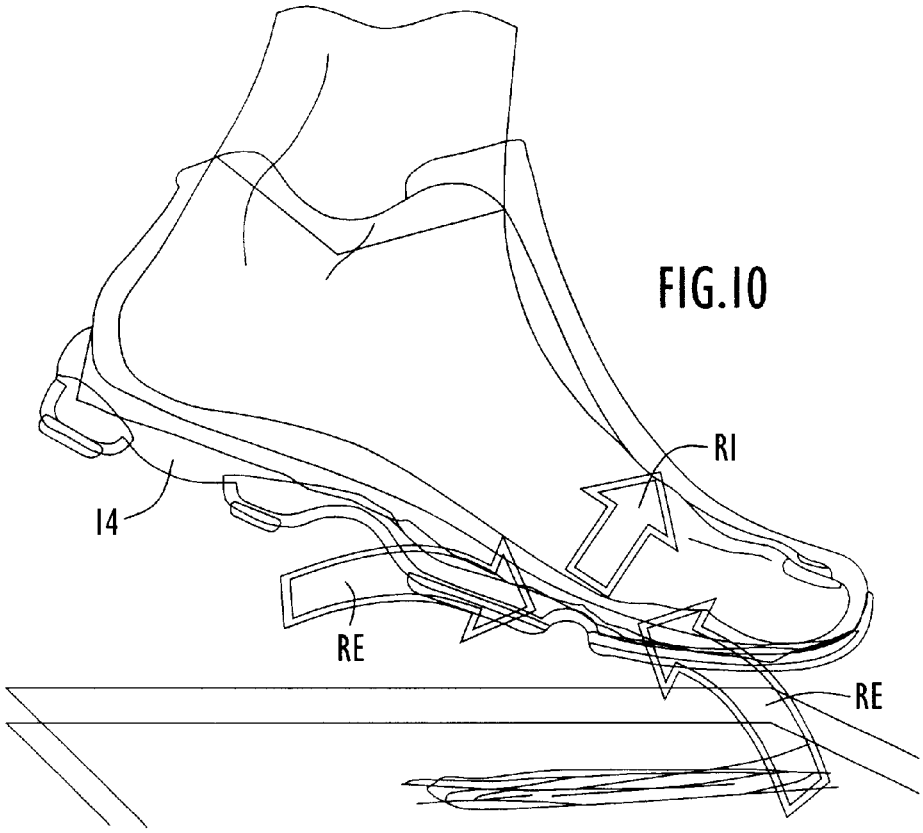
FIG. 10 is a schematic side view of a shoe according to the present invention on a user's foot illustrating the resulting reactions from a vertical- frontal pressure (shown by arrows) when exerted on the shoe.

FIGS. 9 and 10 show how an impulsion generated by the user can be expanded by a shoe constructed in accordance with the present invention. In FIG. 9, it can be seen that an inclined downward action or force (shown by arrow AI) is initiated by the user and transmitted to structural frame system 14 when the shoe contacts the ground. The inclined action AI initiated by the user and transmitted to structural frame system 14 is redirected or freed laterally, as shown by arrows PL in FIG. 9. Flexion of the shoe occurring when the user initiates an impulsion causes frame part 18, which is positioned between insole 16 and sole parts 22, 24 and 26, to deform elastically. FIG. 10 illustrates the resulting reaction forces RI and RE, which are originated from the fact that the frame part 18 tends to return to its original shape after having been deformed by the user's feet when the user starts the impulsion action. As a result, structural frame system 14, made up by insole 16, frame 18 and sole 20, imparts additional energy or an adding effort to the impulsion, further allowing firmness, flexibility, security and comfort to the user.

Generally, the shoe of the present invention includes a superior part, or upper, manufactured from any adequate material, such as, for example, leather, plastics, etc., and a structural frame or frame system attached to the upper. The upper is preferably configured to have different permeability levels between the interior and the exterior part of the shoe to provide an ideal atmosphere within the shoe leading to thermal stability. The shoe upper can be considered as a completely independent part of the shoe structure. The structural frame or frame system of the present invention includes an insole, which is positioned just below the shoe upper, a frame, and a sole, which is the part of the frame structure that has contact with the ground. The object of this frame structure or system, as incorporated into a shoe, is to provide maximum flexibility, comfortable shock absorbing action, a stable support and improved impulsion. Each part of the frame structure is manufactured from a material which is the most suitable to perform each specific function with respect to the overall article. The upper can be manufactured from any suitable material for that specific function. The insole is preferably manufactured from a resilient material having shock-absorbing characteristics with sufficient rigidity to impart some firmness to the shoe upper. Some examples of suitable insole materials include, but are not limited to, ethyl vinyl acetate, which has resilient characteristics, and polyurethane, which has shock-absorbing characteristics. The frame can be manufactured from any suitable material which is relatively firm, light, strong and flexible but is preferably manufactured from a plastic material such as Nylon® or Pebax® (a mixture of polyurethane and Nylon®) or a composite material (e.g., carbon fiber or Kevlar®) (Kevlar® imparts firmness and lightness, and thermal stability). The frame acts by supporting and stabilizing the ensemble, as well as improving flexibility and shock absorption. The sole, which is made up preferably of rubber, imparts adherence to the shoe on the ground, and consequently protection to the user, by avoiding slippage as well as guarantying maximum shoe durability. The shoe upper, the insole, the frame and the sole can be secured to one another in any conventional manner but are preferably joined together with glue, which imparts firmness to the whole article, and forms a sport shoe having excellent performance when utilized in any sport activity.

As to the inventive concept, it must be made clear that the resulting characteristics for the shoe of this invention (i.e., flexibility, shock absorption, support and impulsion) stem from the shoe parts sequence, i.e., the positioning of the parts as employed with respect to one another as well as the materials used for and chemical nature of each part involved. While specific materials have been stated for the various shoe components, it will be appreciated that other materials can be used, dependent upon the intended function of the specific component, and that any modifications or changes in detail are protected by the accompanying claims.

What is claimed is:

1. A shoe comprising an upper and a structural frame system including (a) an insole positioned adjacent and just below said upper and being fixed thereto; (b) a frame positioned adjacent and just below said insole, said frame having a front cutout and a rear cutout, said frame being fixed to said insole; and (c) a sole made up of a plurality of separate, spaced, disconnected parts fixed to said frame, a first of said parts having a cutout which coincides with said front cutout of said frame, and a second of said parts having a cutout which coincides with said rear cutout of said frame, said insole being exposed through said cutout of said first of said parts and said front cutout of said frame and through said cutout of said second of said parts and said rear cutout of said frame.

2. The shoe of claim 1 wherein said first of said parts has an annular configuration adapted to provide cushioning at the center of said sole and circumscribing said cutout which coincides with said front cutout of said frame, said second of said parts has a U-shaped configuration adapted to provide heel cushioning and defining said cutout which coincides with said rear cutout of said frame, said plurality of separate, spaced, disconnected parts further including a third part having a toe bumper portion.

3. The shoe of claim 1 wherein said insole has an upper surface being affixed to said upper, said upper surface including peripheral wall segments transverse with and projecting upwardly from said upper surface, said wall segments providing a U-shaped cross-sectional support, laterally fixing said upper to said insole.

4. A shoe comprising an upper and a structural frame system including:

a substantially planar insole having an upper surface adapted with a peripheral wall segment to laterally support and receive said upper and having a bottom surface;

a frame member attached to said bottom surface and having a front cutout and a rear cutout through which said bottom surface is exposed, said frame member being affixed to said insole and bonded thereto;

a sole including first, second, and third separate, spaced disconnected parts fixed to said frame member, said first part having a cutout which coincides with said front cutout of said frame, said bottom surface being exposed through said cutout of said first part, said second part having a cutout which coincides with said rear cutout of said frame, said bottom surface being exposed through said cutout of said second part, and said third part forming a toe bumper portion.

* * * * *